US005758822A

United States Patent [19]

Yap

[11] Patent Number: 5,758,822

[45] Date of Patent: Jun. 2, 1998

[54] ATOMIZING DEVICE AND METHOD

[75] Inventor: Loo T. Yap, Princeton, N.J.

[73] Assignee: The BOC Group, Inc., New Providence, N.J.

[21] Appl. No.: 739,588

[22] Filed: Oct. 30, 1996

[51] Int. Cl.[6] ..... B05B 11/00

[52] U.S. Cl. ..... 239/1; 239/124; 239/597

[58] Field of Search ..... 239/543, 545, 239/124, 597

[56] References Cited

U.S. PATENT DOCUMENTS

| | | | |
|---|---|---|---|
| 1,086,998 | 2/1914 | Denam | 239/544 X |
| 1,531,877 | 3/1925 | Reimers | 239/543 X |
| 3,622,080 | 11/1971 | Greenwood | 239/545 X |
| 3,638,866 | 2/1972 | Walker | 239/543 X |
| 3,642,211 | 2/1972 | Place | 239/545 X |

FOREIGN PATENT DOCUMENTS

| | | | |
|---|---|---|---|
| 352435 | 3/1935 | Germany | 239/544 |

*Primary Examiner*—Kevin Weldon

*Attorney, Agent, or Firm*—David M. Rosenblum; Salvatore P. Pace

[57] ABSTRACT

An atomization device and method in which two streams of liquid to be atomized are produced within one or more passages so that the streams are directed towards one another and meet to form a stagnation point and therefore generate a shear force within the liquid. An opening is provided within the passage or passages to allow an outlet stream of the liquid to flow in a divergent flow pattern that undergoes atomization due to the shear force developed within the liquid.

14 Claims, 1 Drawing Sheet

ATOMIZING DEVICE AND METHOD

BACKGROUND OF THE INVENTION

The present invention relates to an atomizing device and method in which two streams of liquid are directed against one another to produce shear forces in the liquid that in turn cause the liquid to atomize. More particularly, the present invention relates to such an atomizing device and method in which the two streams of liquid are directed against one another within a passage having an opening through which a divergent, atomized output stream of liquid is discharged. Even more particularly, the present invention relates to such an atomization device and method in which a control stream of liquid is removed from the passage in order to control output flow rate of the output stream.

Many devices and processes rely on the atomization of liquids. Common examples of such devices and processes can be found in spray devices such as paint sprayers to spray paint against a substrate and burners designed to burn heavy fuel oils in an atomized state. Conventionally, liquid through pressure is forced through an atomizing nozzle which converts the liquid into a spray of liquid droplets. Since such nozzles depend on a pressure for the proper functioning, they exhibit a narrow range of operation. For instance, if one turns down the flow, a point is reached at which there does not exist enough pressure to force the liquid out of the atomization nozzle and then into an atomized state. This is particularly troublesome in burner applications where a turn-down capability is desired. Even where a narrow turn-down range is sufficient for the particular application, turn-down operation can be particularly troublesome in burners designed to burn high melting temperature fluids such as heavy fuels oils. During turn-down operation, the low velocities of such fluids can cause high heat losses which in turn can result in solidification or increased viscosity of the fluid. Thus, heating oils, heavy fuel oils and etc. are heated under such conditions. However, the heating can produce liquid-phase reactions which can in turn result in a phenomena known as coking. The coking can cause the atomizing nozzle to clog. In fact, even where coking isn't a problem, many atomizing nozzles are prone to clogging in particulate laden streams in which high liquid velocities in the nozzle (that are required for atomization) dictate small orifice size.

As will be discussed, the present invention provides an atomizing device and method that does not depend on pressure forcing liquids through a small opening to produce atomization and thus, inherently has a wider operating range than atomization nozzles and methods of the prior art.

SUMMARY OF THE INVENTION

The present invention relates to an atomization device in which a means is provided for producing two streams of liquid to be atomized. A passage means including at least one passage is provided for directing the streams towards one another so that the two streams meet at a location of the passage means and at such location form a stagnation point and therefore shear force within the liquid. The passage means has an opening situated at the location to allow an output stream of the liquid to flow from the passage means in a divergent flow pattern, undergoing atomization due to the shear force with the liquid.

In another aspect, the present invention provides a method of atomizing a liquid in which two streams of liquid to be atomized are produced. The two streams are directed towards one another within at least one passage so that the two streams meet at a location of at least one passage and at the location form a stagnation point and therefore generate shear force within the liquid. An output stream of the liquid is allowed to flow from an opening, situated at the location, and the resulting divergent flow pattern undergoes atomization due to the shear force within the liquid.

Since the two streams are directed towards one another, a point is reached at which the velocity of liquid flow drops to zero. From such point, the velocity within the passage increases. This produces shear forces within the liquid. Thus, a liquid stream flowing out of the opening will undergo atomization as a result of the shear forces that have developed within the liquid. Thus, the atomization device and method of the present invention does not depend upon the liquid being forced through a small opening under pressure to produce shear forces in the liquid. Because the liquid has an already developed shear force, turn down characteristics can easily be controlled by drawing a control stream which, as will be discussed, can be recycled back from the two streams to be directed towards one another. In such manner, a nozzle of the present invention can be made to exhibit the greater range of operability than atomization nozzles of the prior art. Moreover, another consequence is that the nozzle configuration can be much larger than an atomization nozzle of the prior art while still handling smaller flow rates. The advantage here is that even during normal operation, the nozzle is far less resistant to clogging. In addition if particles are in the feed stream, particles will preferentially flow back with the control stream.

BRIEF DESCRIPTION OF THE DRAWINGS

While the specification concludes with claims distinctly pointing out the subject matter that applicants regard as their invention, it is believed the invention will be better understood when taken in connection with the accompanying drawings in which:

DETAILED DESCRIPTION

Figure 1:
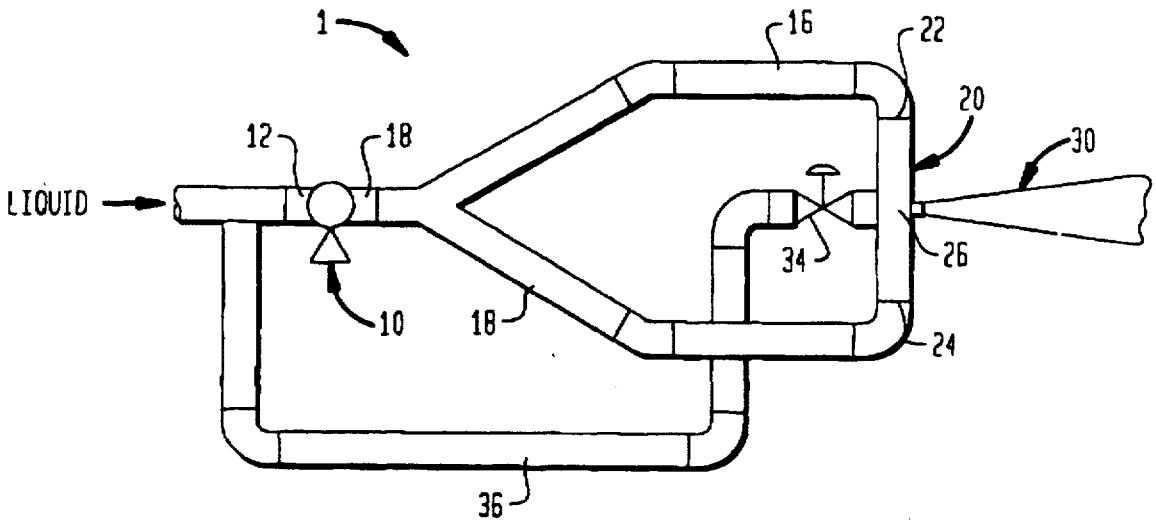
FIG. 1 is an elevational view of atomization device for carrying out a method in accordance with the present invention.

With reference to FIG. 1, an atomizing device 1 is illustrated that is configured to act as a burner nozzle. However, it is to be noted that the present invention is not so limited and can be applied to any atomizing application.

Atomizing device 1 utilizes a pump 10 having an inlet 12 and an outlet 14 to pump a liquid through a piping system having two branches 16 and 18. The flow through the two branches 16 and 18 thus acts as a means for forming two streams. A straight pipe 20 having ends 22 and 24 are connected to branches 16 and 18, respectively. Straight pipe 20 directs the two streams towards one another so that the two streams meet at a location 26 of straight pipe 20. A stagnation point is formed at location 26 and from this stagnation point, a shear force is developed within the liquid to be atomized.

Figure 2:
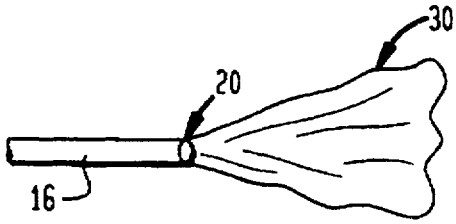
FIG. 2 is a fragmentary coupling view of FIG. 1.
Figure 3:
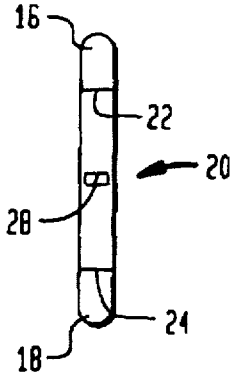
FIG. 3 is a front elevational view of FIG. 1.

With additional reference to FIGS. 2 and 3, at location 26, an opening 28 is provided which allows an output stream 30 of the liquid to flow from the straight pipe 20 in a divergent flow pattern which undergoes atomization due to the shear force that has previously been developed within the liquid. In the illustrated embodiment the flow rates of the streams within branches 16 and 18 are equal and output stream 30 is therefor projected in a direction normal to straight pipe 20.

If the flow rates were unequal, output stream 30 would deflect from the normal and toward the stream having the lower flow rate. In such manner, spray direction can be controlled. Control of flow rates could be effectuated by means of valves-or unequal pipe size.

The rectangular configuration of slit-like opening 28 produces the fan-shape flow pattern that is illustrated. Other shapes could be used for instance, a circular shape would cause the flow pattern to assume a conical flow pattern. A point worth mentioning is that although a straight pipe 20 is illustrated, a curved pipe could equally be used to impart a velocity component in the direction that output stream 30 is projected. This would result in greater projection of output stream 30. In place of a curved pipe, two pipes may be used which would meet at an angle. It would again form a forward component in the velocity of flow and therefore a greater projection of the output stream 30. Furthermore, although not illustrated, atomization could be further augmented with supplemental flows of atomization fluids such as oxidant.

In order to properly control the output flow rate of output stream 30, an outlet conduit 32 is provided which is connected to straight pipe 26 to allow a control stream of the liquid to be released from straight pipe 20. The control stream is controlled by a valve 34 which can preferably be a proportional valve. When opened, proportional valve 34 increases the flow rate of the control stream and therefore decreases the flow rate of output stream 30 and vice versa. The return pipe 36 is connected to proportional valve 34 which is in turn in communication with inlet 12 of pump 10. This recycling of liquid causes the two streams of liquid formed in branches 16 and 18 to be formed in part from the control stream flowing within pipe 36. As can be appreciated, an atomization device in accordance with the present invention could be constructed without the provision for formation of a control stream. Or ultimately, the control stream could be provided without a valve 34. In such case, the sizing of the return pipe 36 and outlet conduit 32 would control flow of the control stream and thus the flow rate of the output stream which of course would have a fixed flow rate. Also, although not illustrated, return pipe 36 could be rerouted to the top of a supply tank for the liquid to be atomized.

Although the present invention has been described with reference to a preferred embodiment, as could be appreciated by those skilled in the art, numerous changes, additions, and omissions could be made without departing from the spirit and scope of the invention.

I claim:

1. An atomization device comprising:

means for producing two streams of liquid to be atomized;

said means for producing including a pump and Y branch passage;

passage means including at least one passage for directing the streams towards one another so that the two streams meet at a location of said passage means and at such location form a stagnation point and therefore generate shear force within the liquid;

said passage means having an opening, situated at said location so that an output stream of said liquid flows from said passage means and out of said opening in a divergent flow pattern undergoing atomization due to the shear force within the liquid;

outlet means also located at said location to allow a control stream of said liquid to be released from said passage means, the outlet means in communication with said two stream producing means so that said control stream is recycled back to said two stream producing means; and valve means associated with said outlet means to control flow rate of said control stream and therefore output flow rate of said output stream flowing from said opening.

2. The atomization device of claim 1, wherein said passage means is configured such that said two streams of the liquid are directed towards one another in an inline relationship.

3. The atomization device of claim 1 wherein said two stream have equal flow rates.

4. The atomization device of claim 1, wherein:

said passage means comprises a straight pipe having opposed ends;

said location is situated intermediate said two opposed ends; and said outlet means comprises an outlet at said location and an outlet conduit connected to said straight pipe and in communication with said outlet.

5. The atomization device of claim 1, wherein said opening is of slit-like configuration so that said flow pattern is of fan-like configuration.

6. The atomization device of claim 1, wherein said stream producing means comprises:

a pump having an inlet and an outlet;

a piping system having two branches to form said two streams of said liquid, said two branches connected to said passage means; and a return pipe communicating between said inlet of said pump and said valve means.

7. The atomization device of claim 6, wherein said passage means comprises a straight pipe having opposed ends;

said location is situated intermediate said two opposed ends;

said outlet means comprises an outlet at said location and an outlet conduit connected to said straight pipe and in communication with said outlet; and said branches of said stream producing means are connected to said opposed ends of said pipe.

8. The atomization device of claim 7, wherein said opening is of slit-like configuration so that said flow patter is flat and fan-shaped.

9. A method of atomizing a liquid comprising:

producing two streams of liquid to be atomized;

directing the streams towards one another in at least one passage so that the two streams meet at a location of said at least one passage and at such location form a stagnation point and therefore shear force within the liquid;

allowing an output stream of said liquid to flow from an opening, situated at said location, in a divergent flow pattern undergoing atomization due to the shear force within the liquid;

releasing a control stream of said liquid from said passage means; and controlling flow rate of said control stream and therefore the output flow rate of said output stream flowing from said opening.

10. The method of claim 9, wherein said control stream is recycled so that said two streams of liquid to be atomized are produced in part from said control stream.

11. The method of claim 9 or claim 10 wherein said two streams are directed toward one another in an inline relationship.

12. The method of claim 9, wherein said divergent flow pattern is fan-shaped.

13. The method of claim 11, wherein said divergent flow pattern is fan-shaped.

14. The method of claim 9 wherein the two streams have equal flow rates.

* * * * *